US006428135B1

(12) United States Patent
Lubinsky et al.

(10) Patent No.: US 6,428,135 B1
(45) **Date of Patent: *Aug. 6, 2002**

(54) ELECTRICAL WAVEFORM FOR SATELLITE SUPPRESSION

(75) Inventors: Anthony R. Lubinsky, Webster; Diane C. Freeman, Pittsford; Simon D. Yandila, Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/679,761

(22) Filed: Oct. 5, 2000

(51) Int. Cl.[7] ..... B41J 29/38; B41J 25/308
(52) U.S. Cl. ..... 347/11; 347/8
(58) Field of Search ..... 347/8, 11

(56) References Cited

U.S. PATENT DOCUMENTS

| | | | | |
|---|---|---|---|---|
| 3,683,396 A | | 8/1972 | Keur et al. | 347/75 |
| 4,368,474 A | | 1/1983 | Togawa et al. | 347/76 |
| 4,513,299 A | | 4/1985 | Lee et al. | 347/15 |
| 4,652,153 A | | 3/1987 | Kotsuzumi et al. | 400/56 |
| 4,972,211 A | | 11/1990 | Aoki | 347/11 |
| 5,303,141 A | | 4/1994 | Batchelder et al. | 364/149 |
| 5,360,276 A | | 11/1994 | Petermann | 400/55 |
| 5,361,084 A | | 11/1994 | Patton et al. | 347/15 |
| 5,428,375 A | | 6/1995 | Simon et al. | 347/12 |
| 5,461,406 A | | 10/1995 | Lorenze, Jr. et al. | 347/65 |
| 5,468,076 A | | 11/1995 | Hirano et al. | 400/59 |
| 5,495,270 A | | 2/1996 | Burr et al. | 347/10 |
| 5,796,416 A | | 8/1998 | Silverbrook | 347/47 |
| 5,894,036 A | | 4/1999 | Tylko | 472/279 |
| 5,901,425 A | | 5/1999 | Bihl et al. | 29/25.35 |
| 6,036,302 A | | 3/2000 | Hotomi | 341/53 |
| 6,044,762 A | | 4/2000 | De Boer et al. | 101/466 |
| 6,059,392 A | | 5/2000 | Park | 347/8 |
| 6,077,338 A | * | 6/2000 | Wallstrom | 106/31.6 |
| 6,088,050 A | * | 7/2000 | Ng | 347/237 |
| 6,123,472 A | * | 9/2000 | Elgee | 400/283 |

FOREIGN PATENT DOCUMENTS

| | | | | |
|---|---|---|---|---|
| EP | 0 389 738 A | | 10/1990 | B41J/2/14 |
| EP | 0 473 178 A | | 3/1992 | B41J/2/01 |
| EP | 0 841 164 A1 | * | 5/1998 | B41J/2/045 |
| JP | 63 212585 A | | 9/1988 | B41M/5/00 |
| JP | 2-184449 A | | 7/1990 | B41J/2/045 |
| WO | WO 98/08687 | | 3/1998 | B41J/2/21 |

OTHER PUBLICATIONS

IBM Technical Disclosure Bulletin, vol. 29, No. 3, Aug. 1986, pp. 1412–1413, Capacitive Head Gap for Printers, Mar. 4, 2002.

Keyence LC–2430 Laser Displacement Sensor Tests on Film Hold Breadboard, Feb. 27 to 29, 1996, Mar. 4, 2002.

* cited by examiner

*Primary Examiner*—John Barlow
*Assistant Examiner*—Alfred E. Dudding
(74) *Attorney, Agent, or Firm*—Norman Rushefsky

(57) ABSTRACT

An inkjet printing apparatus and method of operating an inkjet printhead provides an inkjet orifice of the printhead that is located within a predetermined spacing of less than 1000 micrometers, and more preferably in a range of 50 to less than 500 micrometers for printing high resolution images. Electrical drive signals are provided to the printhead, the drive signals being adapted to enable the printhead to generate a droplet. In response to the drive signals, a free droplet is formed between the orifice and a receiver member and deposits a droplet upon the receiver member substantially without presence of any satellites.

26 Claims, 4 Drawing Sheets

ELECTRICAL WAVEFORM FOR SATELLITE SUPPRESSION

CROSS REFERENCE TO RELATED APPLICATIONS

This application is related to the following U.S. applications filed in the names of the inventors herein:

1. U.S. application Ser. No. 09/680,378, filed on Oct. 5, 2000 and entitled "Apparatus and Method for Maintaining a Substantially Constant Closely Spaced Working Distance Between an Inkjet Printhead and a Printing Receiver"; and 2. U.S. application Ser. No. 09/679,931 filed on Oct. 5, 2000 and entitled "Electrical Drive Waveform for Close Drop Formation".

FIELD OF THE INVENTION

The present invention relates to imaging apparatus and methods, and more particularly relates to an imaging apparatus and method capable of ejecting liquid structures, which become single liquid drops, without accompanying satellite drops, before reaching a receiver surface.

BACKGROUND OF THE INVENTION

Inkjet imaging devices use the controlled ejection of small droplets of liquid, to produce an image. Typically, the liquid is ejected through one or more nozzle orifices, which are produced in a nozzle plate. The pressure pulse, which ejects the liquid drop through a nozzle orifice is typically produced by the application of an electrical drive waveform to an electromechanical transducer, as in a piezoelectric printhead; or to an electrothermal transducer, or resistor, as in a thermal printhead. The present invention concerns electrical drive waveforms particularly designed for printing images requiring accurate and artifact-free deposition of the liquid drops on the receiving medium, as for example in graphic arts printing. Examples of ink or printing liquids used with lithographic printing plates are described in U.S. Pat. No. 6,044,762; however, the invention is not limited to the fluids mentioned only in that patent but applies to other fluids suited for ejection from an inkjet printhead as taught herein which are generally referred to herein as an ink or printing liquid.

In the field of continuous inkjet, in which a continuous pressurized fluid jet is caused to break into drops in synchronization with a vibrating transducer, and imagewise caused to deflect, some prior work in the art has been done on the suppression of unwanted satellite drops. For reference example, Keur et al. in U.S. Pat. No. 3,683,396 discloses a method of nozzle design in which the mechanical resonance frequency of the nozzle is chosen to minimize the occurrence of satellite drops. Togawa et al., in U.S. Pat. No. 4,368,474, discloses a charge detector that detects the presence of satellite drops, and regulates a voltage applied to a vibrating transducer, to suppress the satellites.

In the field of drop-on-demand inkjet, in which a drop of liquid is ejected from a nozzle only upon application of an electrical drive signal to an actuator in communication with the nozzles, some prior work in the art has been done on the suppression of satellite drops. For reference example, Lorenze et al. in U.S. Pat. No. 5,461,406 discloses a method of designing a front face, or nozzle, to eliminate misdirected satellite drops in a thermal inkjet printhead.

However, none of the above references address the problem of suppressing or eliminating satellite drops, using an electrical drive waveform particularly designed for ejection of a particular liquid type. It is accordingly an object of the present invention to provide a method and apparatus for forming such liquid drops without satellites, in order to allow accurate and artifact-free placements of the drops onto a receiving medium.

SUMMARY OF THE INVENTION

It has been known to use an inkjet printhead to eject drops of liquid onto the surface of a receiving medium to produce an image, as shown in FIG. 1. However, a problem with the prior art has been that in actual practice, the liquid structure that is actually ejected from the printhead nozzle may consist of a liquid droplet connected to or followed by, a ligament or tail, which in turn may break up into a series of satellite drops. This is illustrated schematically in FIG. 1, and in actual practice, in the stroboscopic photomicrographs of FIG. 2*b* and FIG. 2*c*. If a receiver in relative motion to the printhead were placed close to the nozzle plate in a position to receive the ejected drops, as for example at the head position of the droplet-satellite object and FIG. 2*c*, then a mark on the receiver would be formed in the shape of a large dot followed by a succession of small satellite dots, which is undesirable.

It is, therefore, an object of the present invention to provide a method and apparatus of producing liquid structures, which become single drops of liquid, prior to the time that the liquid drops contact the surface of a moving receiver.

Advantage of such a method is that images free of artifacts such as satellite dots, may be produced. Another advantage of such a method is that images requiring high resolution and accurately produced dot structures, such as graphic arts images, may be produced.

In accordance with a first aspect of the invention there is provided a method of operating an ink jet printhead comprising providing an inkjet orifice of the printhead located within a predetermined spacing of less than 1000 micrometers from a receiver member that is moving relative to the orifice so as to present different portions of the receiver member to the orifice at the predetermined spacing; providing electrical drive signals to the printhead, the electrical drive signals being adapted to enable the printhead to generate a droplet of a printing liquid; and forming a free droplet of the printing liquid substantially free of any satellites between the orifice and the receiver member and depositing the droplet upon the receiver member.

In accordance with a second aspect of the invention there is provided an inkjet printing apparatus comprising a printhead having an inkjet orifice within a predetermined spacing of less than 1000 micrometers from a receiver member that is moving relative to the orifice so as to present different portions of the receiver member to the orifice at the predetermined spacing; and a source of electrical drive signals to the printhead, the electrical drive signals being adapted to enable the printhead to generate a free droplet substantially without presence of any satellites that would otherwise form a mark on the receiver member.

BRIEF DESCRIPTION OF THE DRAWINGS

While the specification concludes with the claims particularly pointing out and distinctly claiming the subject matter of the present invention, it is believed that the invention will be better understood from the following detailed description when taken in conjunction with the following drawings wherein:

DETAILED DESCRIPTION OF THE INVENTION

The present description will be directed in particular to elements forming part of, or cooperating more directly with, an apparatus and method and in accordance with the present invention. It is to be understood that elements not specifically shown or described may take various forms well known to those skilled in the art.

Figure 1:
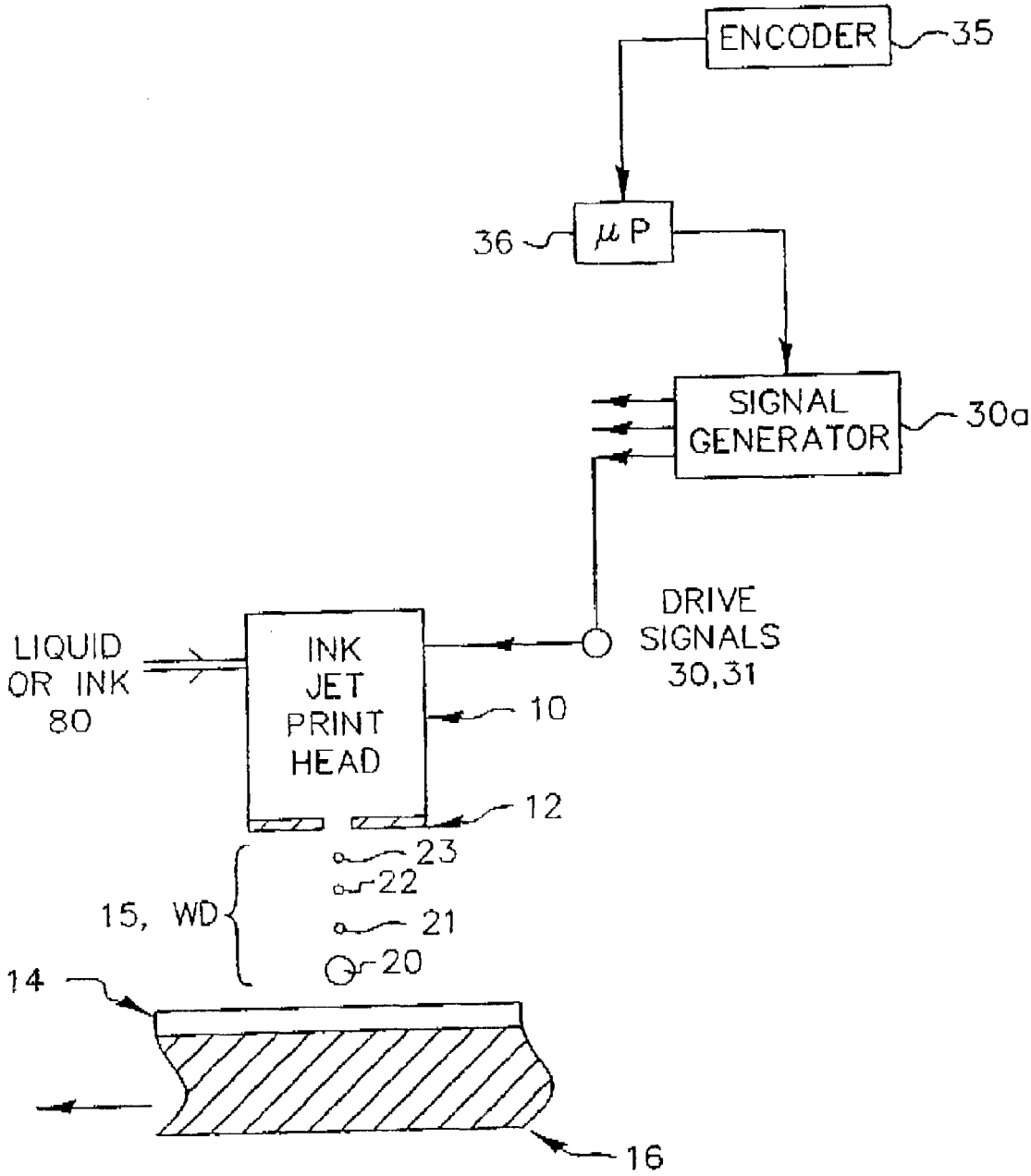
FIG. 1 is a simplified schematic view of an inkjet printhead, showing ejection of a liquid drop onto a receiver, and indicating schematically the production of a series of unwanted satellite drops, as well as a main drop.

Therefore, referring to FIG. 1, an inkjet printhead 10 is shown, ejecting a liquid drop 20 followed by a succession of satellite drops 21, 22, 23 through a nozzle plate 12, onto the surface 14 of a moving receiver medium 16. The inkjet printhead 10 is supplied with liquid or ink to be ejected, and is activated by electrical drive signals 30, 31.

Figure 2A:
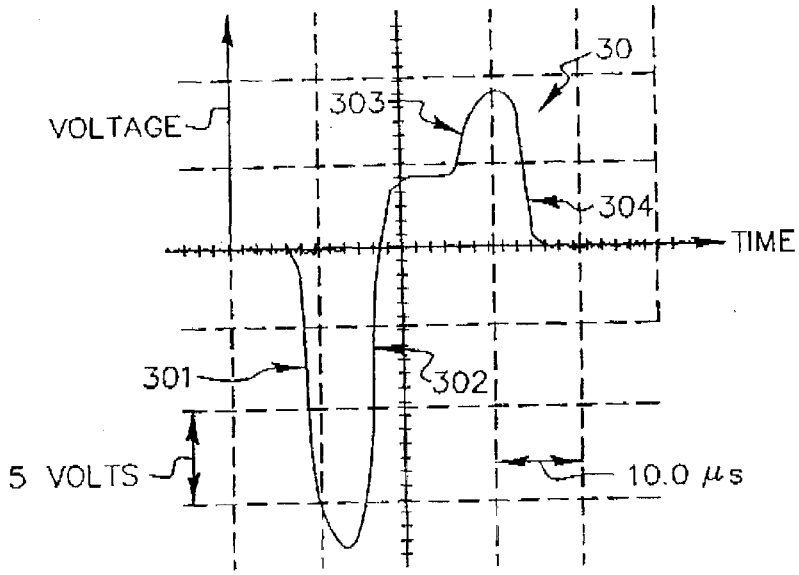
FIG. 2*a* is a graph of voltage versus time, illustrating the shape of an electrical drive waveform applied to an inkjet printhead, in the prior art.

A problem in the prior art has been the production of undesirable satellite drops, as shown schematically in FIG. 1. FIG. 2*a* shows a photomicrograph of a liquid structure being ejected from a nozzle plate 12 of a printhead 10, taken at a time close to the time that the long ligament, or tail, 25, detaches itself from the nozzle plate 12. It is observed experimentally that many liquids, when ejected in the form of a long ligament 25, tend to break up into one or more smaller drops 21, 22, 23, or satellites, as shown in FIG. 2*c*. If the satellite drops 21, 22, 23, etc., do not all combine with the main drop prior to the time that the main drop hits a moving receiver surface 14, as is true in this prior art example, then artifacts in the form of a series of small satellite dots will be formed on the receiver surface. This problem becomes exacerbated when the working distance between the nozzle plate 12 and the receiver surface 14 is reduced, in order to increase the accuracy of drop placement, in applications like graphic arts printing, requiring high accuracy. Therefore, it is desirable to eject liquid structures which become single fluid drops, before contacting a moving receiver surface at a working distance (WD) 15 between nozzle plate 12 and receiver surface 14.

Referring to FIG. 2*a*, there is shown an electrical drive signal 30 used for driving an inkjet printhead 10, in the prior art. The electrical signal may be produced using a signal generator and amplifier by methods well known to those skilled in the art. The inkjet printhead may contain a piezoelectric actuator, whose electrodes are connected to receive the drive signals 30. The electrode polarities in the present example are chosen such that the downward-going voltage edge 301, in FIG. 2*a* causes an outward mechanical expansion of the actuator, drawing liquid 80 into the printhead 10. The upward-going voltage edges 302 and 303 cause inward compression of the actuator, expelling liquid from the nozzles. Finally, the downward-going edge returns the actuator to its original state, in readiness for the next actuation.

Figure 2B:
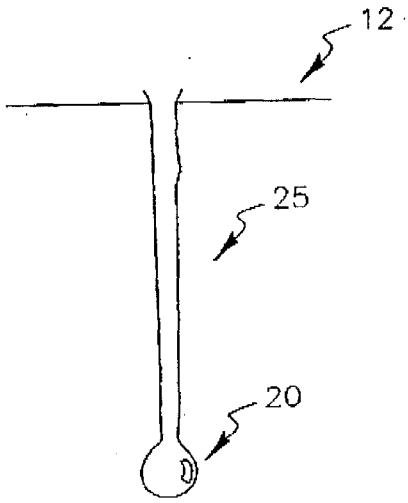
FIG. 2*b* is a photomicrograph of the liquid structures that are ejected, at a time close to the time that the liquid structure detaches itself from the nozzle plate, as a result of applying the electrical drive waveform in FIG. 2*a* to an inkjet printhead.
Figure 2C:
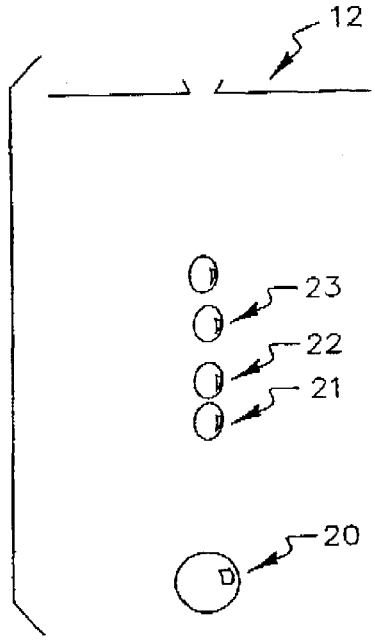
FIG. 2*c* is a photomicrograph of the liquid structures that are ejected, at a time 30 microseconds after the time shown in FIG. 2*b*, as a result of applying the electrical drive waveform in FIG. 2*a* to an inkjet printhead.

Referring to FIG. 2*b*, there is shown a photomicrograph of the liquid structures ejected from the nozzle plate 12, at a time close to the time that the liquid structure detaches itself from the nozzle plate 12, upon application of the prior art electrical drive waveform 30. It is observed that the liquid structure comprises a subdrop 20, connected to a long ligament 25. Referring to FIG. 2*c*, there is shown a photomicrograph of the liquid structure ejected as a result of application of prior art drive waveform 30, at a time 30 microseconds after the time shown in FIG. 2*b*. It is observed that the long ligament 25 breaks into a series of satellite drops 21, 22, 23, etc. It is further found that the said satellite drops never rejoin the main drop 20. Thus, regardless of the position at which a moving receiver surface 14 is placed, unwanted satellite dots will be produced on the receiver.

Figure 3A:
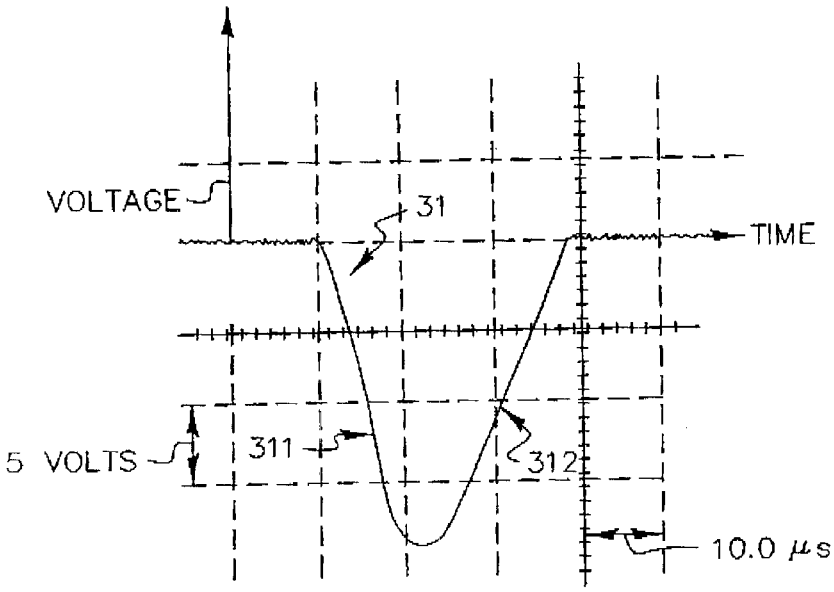
FIG. 3*a* is a graph of voltage versus time, illustrating the shape of the electrical drive waveform applied to an inkjet printhead, in the present invention.

Now referring to FIG. 3*a*, there is shown an electrical drive waveform 31, according to the present invention. As before, when the electrodes of a piezoelectric actuator are connected to receive drive waveform 31, the initial downward-going voltage edge 311 causes a mechanical expansion of the actuator, which draws liquid 80 into the printhead 10. In the present example of FIG. 3*a*, the single upward-going voltage edge 312 has been applied, after a different time delay, than in the prior art case 30. The overall magnitude of the applied ejecting voltage edge 312 is also different from the combined magnitude of the ejecting voltage edges 302 and 303, in the prior art waveform 30. The piezoelectric actuator responds not to absolute voltage, but to changes in voltage, or "edges." In this example the firing edges follow the filling edge in time in a-"fill and shoot" mode. For this inkjet channel the channel length L was about 5 mm and the value of 4 L/c is about 13.34 microseconds. Firing efficiency in general depends on the time delay between the filling and firing edges, and the most efficient value for the delay in turn depends on the channel length or acoustic resonant frequency. Choosing an overall pulse width is an initial step in constructing a waveform, however as noted herein special tuning of this pulse width can provide significant advantage in obtaining droplets that are generally free of accompanying satellite subdroplets which tend to form artifacts on the receiver member.

A typical working distance 15 (WD), as practiced in the prior art may be between 1 and 2 mm, resulting in a particular average error in the placement of drops in the prior art. It would clearly be desirable to reduce the working distance substantially, thus reducing the dot placement error. It is desirable to eject a fluid structure which becomes a liquid drop, close to the nozzle plate 12. It would be desirable to form a droplet that is used for recording the pixel of the image wherein the receiver member to be printed is closer than 1000 micrometers, preferably in the range of 50 to less than 1000 micrometers, and more preferably less than 500 micrometers and still more preferably in the range of 50 to less than 500 micrometers from the nozzle plate 12.

Figure 3B:
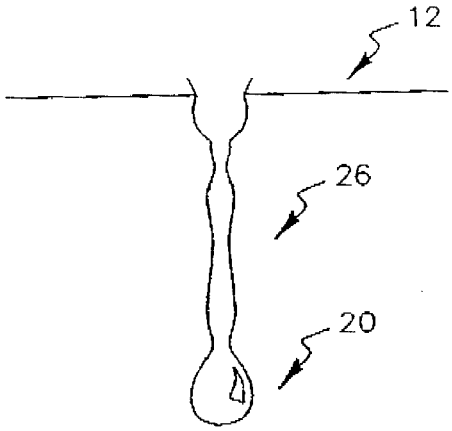
FIG. 3*b* is a photomicrograph of the liquid structures that are ejected, at a time close to the time that the liquid structure detaches itself from the nozzle plate, as a result of applying the electrical drive waveform in FIG. 3*a* to an inkjet printhead.
Figure 3C:
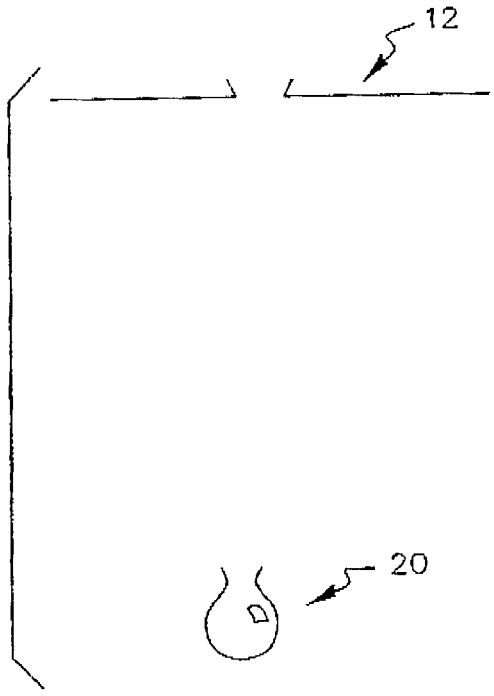
FIG. 3*c* is a photomicrograph of the liquid structures that are ejected, at a time 30 microseconds after the time shown in FIG. 3*b*, as a result of applying the electrical drive waveform in FIG. 3*a* to an inkjet printhead.

Referring to FIG. 3*b* there is shown a photomicrograph of the liquid structure ejected from the nozzle plate 12, upon application of the present invention electrical drive waveform 31 to the same printhead 10 and liquid 80 as illustrated in FIG. 2*b*. The photomicrograph is taken at the same time relative to the initial application of the electrical drive signal, as in the prior art case in FIG. 2*a*. It is observed that a differently shaped liquid structure is now ejected, with a shorter ligament 26, connected to a main drop 20. Further, in FIG. 3*c*, there is shown a photomicrograph of the liquid structure ejected as a result of the present invention waveform 31, at a time 30 microseconds after the time shown in FIG. 3*b*. In the present case, the ligament 26 breaks off one small drop, which then quickly combines with the main drop 20, as the shown in FIG. 3*c*. If the liquid drop formed by application of the present invention electrical drive waveform 31 contacts a moving receiver surface 14 at the time shown in FIG. 3*c*, or at any time thereafter, a single dot without artifacts will be produced on the receiver. It has been found possible to provide drive waveforms 31 which suppress satellite drop formation when ejecting fluids like inks for printing, and also when ejecting printing liquids which may be used for producing printing plates.

Figure 4:
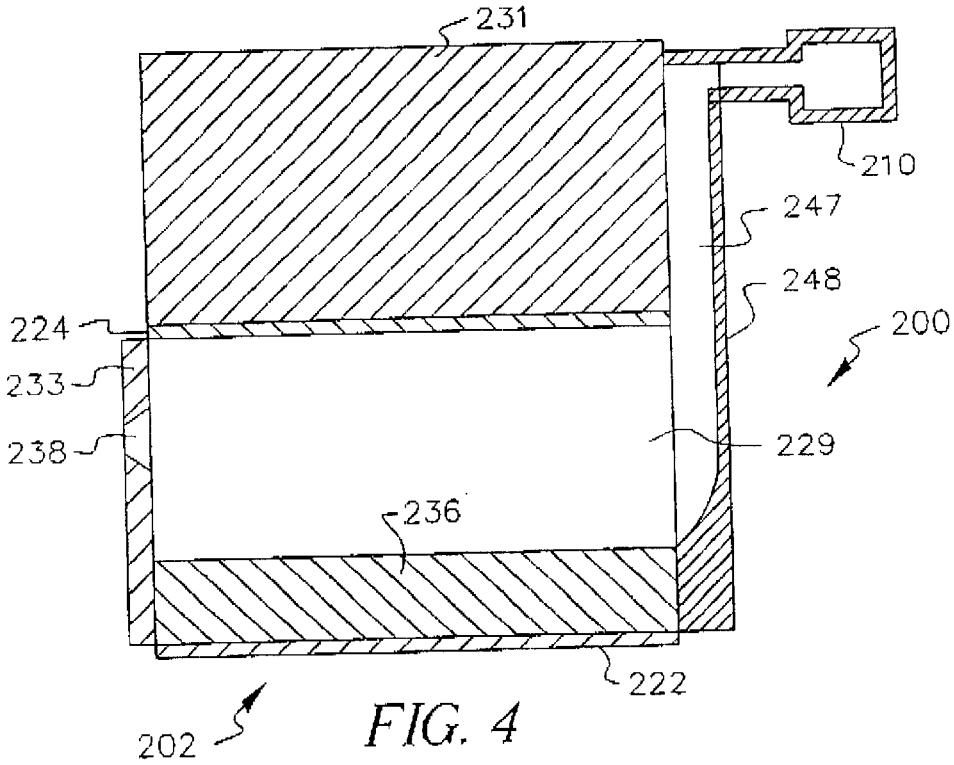
FIG. 4 (PRIOR ART)
FIG. 4 is a cross-sectional side view of an inkjet printhead structure showing in greater detail a single channel of the inkjet printhead.

FIG. 4 is a cross-sectional side view of a single channel of the inkjet printhead structure 200 for a piezoelectric inkjet printer constructed in accordance with the description provided in U.S. Pat. No. 5,901,425, the contents of which relating to such structure are incorporated herein by reference and which is further descriptive of the printhead structure of FIG. 1. Printhead structure 200 comprises a printhead transducer 202, formed of piezoelectric material, into which is cut an ink channel 229. The ink channel 229 is bordered along one end with a nozzle plate 233 having an orifice 238 defined therethrough. A rear cover plate 248 is suitably secured to the other end of ink channel 229. A base portion 236 of the printhead transducer 202 forms the floor of the ink channel 229, while an ink channel cover 231 is secured to the upper opening of the printhead transducer 202. Ink channel 229 is supplied with ink from an ink reservoir 210 through ink feed passage 247 in rear cover plate 248. Actuation of the printhead transducer 202 results in the expulsion of ink drops from ink channel 229 through the orifice 238 in nozzle plate 233.

Figure 5:
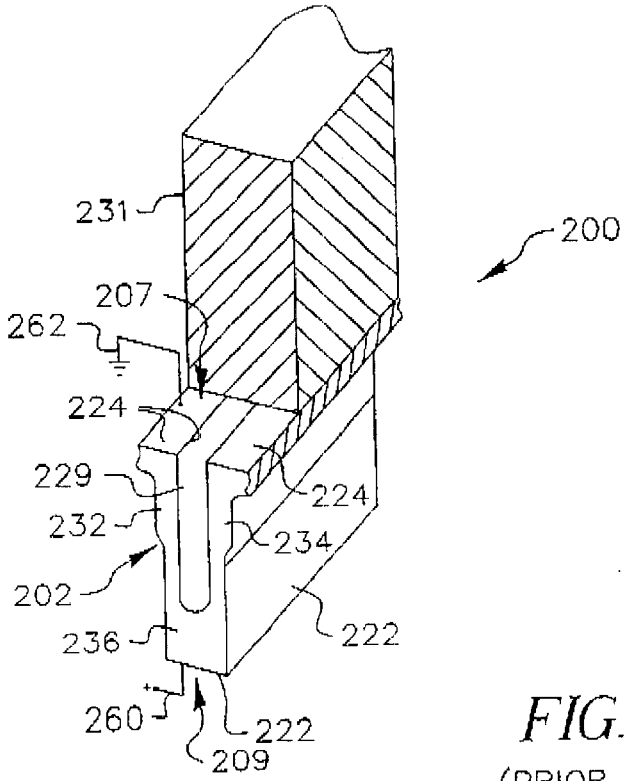
FIG. 5 (PRIOR ART)
FIG. 5 is a partial perspective view of the inkjet printhead structure of FIG. 4.

Referring to FIG. 5, the printhead transducer of FIG. 4 is shown in greater detail. The printhead transducer comprises a first wall portion 232, a second wall portion 234, and a base portion 236. The upper surfaces of the first and second wall portions 232 and 234 define a first face 207 of the printhead transducer 202, and the lower surface of the base portion 236 defines a second opposite face 209 of the printhead transducer 202. Ink channel 229 is defined on three sides by the inner surface of the base portion 236 and the inner wall surfaces of the wall portions 232 and 234, and is an elongated channel cut into the piezoelectric material of the printhead transducer 202, leaving a lengthwise opening along the upper first face of the printhead transducer 202. One end of ink channel 229 is closed off by a nozzle plate 233 while the other end is closed off by rear cover plate 248. A metallization layer 224 coats the inner surfaces of ink channel 229 and is also deposited along the upper surfaces of the first wall portion 232 and second wall portion 234. An ink channel cover 231 is bonded over the first face of the printhead transducer 202, to close off the lengthwise lateral opening in the ink channel 229. A second metallization layer 222 coats the outer surfaces of the base portion 236, and also extends approximately halfway up each of the outer surfaces of the first and second wall portions 232 and 234.

The metallization layer 222 defines an addressable electrode 260, which is connected to an external signal source to provide electrical drive signals to actuate the piezoelectric material of printhead transducer 202. The metallization layer 224 defines a common electrode 262 which is maintained at ground potential. The piezoelectric material forming the printhead transducer 202 is PZT, although other piezoelectric materials may also be employed in the present invention.

The printhead of FIGS. 4 and 5 works upon the principle of the piezoelectric effect, where the application of an electrical signal across certain faces of piezoelectric material produces a corresponding mechanical distortion or strain in that material. In general, an applied voltage of one polarity will cause material to bend in the first direction, and an applied voltage of the opposite polarity will cause material to bend in the second direction opposite that of the first. Application of a positive voltage to electrodes 260 results in movement of the base portion 236 and wall portions 232 and 234 of the printhead transducer inward, toward the channel 229, resulting in a diminishment of the interior volume of the ink channel 229. Upon application of negative voltage to the addressable electrode 260 there is a resulting net volume increase in the interior volume of the ink channel 229.

In operation, the application of electrical drive signals to the addressable electrode 260 of the printhead transducer 202 causes a mechanical movement or distortion of the walls of ink channel 229, resulting in a volume change within the channel 229. This change in volume within the channel 229 generates an acoustic pressure wave within the ink channel 229, and this pressure wave within the channel 229 provides energy to expel ink from orifice 238 of printhead structure 220 onto a print medium. This particular printhead operates primarily in the shear mode and there are two orifices-one in the nozzle plate (35 micrometers at the outside, with a tapered shape to 75 micrometers at the back) and one at the channel inlet.

In accordance with the invention described herein a parameter of the drive signal for example amplitude, frequency, and/or shape of the applied electrical waveform is adjusted to provide a free droplet expelled from the printhead 10 to the surface of a receiver sheet or member that is positioned preferably at a spacing of less than 1000 micrometers, more preferably in the range of 50 to less than 1000 micrometers, and still more preferably less than 500 micrometers from the orifice of the printhead and which is moving relative to the orifice. The most preferred spacing between the orifice and the receiver member is of the order of 50 to less than 500 micrometers.

The signals described herein may be provided by output from a signal generator 30*a* that is modified so as to be adapted or tuned to provide a free droplet in the space between the orifice and the closely positioned receiver member. The term "free" implies not connected to orifice or receiver member. The signals from the signal generator 30*a* may be amplified and applied to the respective printhead transducer's to eject a droplet at a specific location from a specific ink jet orifice. The printhead may also include a switch array having a series of digitally controlled switches which selectively control which individual channels of the array of printhead channels will be permitted to receive an actuation signal for expelling an ink jet drop. Typically, signals from an external encoder 35 are provided to a microprocessor 36 which outputs control signals to the signal generator linked to the motion of the printhead so that the expelled ink drops are ejected with optimal timing to impact a print medium at the correct position.

Reference is made to commonly assigned U.S. application Ser. No. 09/680,378, filed Oct. 5, 2000, in the name of Anthony R. Lubinsky et al in which application description is made of an apparatus and method for maintaining a substantially constant closely spaced working distance between an inkjet printhead's orifice(s) and a printing receiver or medium, the contents of that description are incorporated herein by reference. Typically the printheads described herein include a plurality of orifices that may be substantially simultaneously energized The printheads described herein are suited for graphic arts printing in which the spatial frequency of the microdots forming the image may be very high for example 1200–2400 dpi or higher. In using the printheads the ink receiving medium or element may be moved or translated in a first direction y while the printhead may be moved or scanned across the receiving medium or element in a direction x that is perpendicular to y. Spacing between the orifice and the ink-receiving medium is in a direction z that is perpendicular to the plane xy. Velocity of relative movement of the orifice vis-a-vis the receiving medium can range up to one meter per second.

The drops produced by this printhead are about 25 picoliters in volume and about 36 microns in diameter and the speed of the drops is generally around 5 meters per second. Density of the ink or printing liquid used is about 1.0–1.1 g/cc and the viscosity is in the range of 2–6 cp and surface tension of the ink printing liquid used is in the range of 32–36 dynes/cm. In the event that the printing liquid is heated in the printhead, the above values for the ranges of density, surface tension and viscosity are determined at the temperature of the printing liquid in the printhead. Surface tension of the printing liquid is a static measurement and may be measured with a Kruss Pressure Tensiometer. The viscosity of the printing liquid may be measured using a Rheolyst AR 1000 Rheometer from TA Instruments. In order to provide for high-resolution printing and a desired resolution of 1200–2400 dpi it is desirable to have a preferred range of free printing liquid droplet size be 0.5–30 picoliters, however the invention in its broader aspects is suitable also for droplet sizes of greater than 30 picoliters.

Therefore, electrical drive waveforms have been provided which cause the ejection of liquid jets which become single fluid drops, before contacting a moving receiver surface. Drive waveforms which cause single drop ejection can be provided for ejecting fluids like inks for printing and also for ejecting printing liquids which may be used for producing printing plates. In the preferred embodiment, both the shape and the voltage of the electrical drive waveform may be different, from the prior art.

Although the invention has been described primarily with reference to piezoelectric actuated inkjet printheads, adjustments to driving signals may also be provided to other types of inkjet printheads such as electrothermal printheads. The printhead may be of the drop on demand type as described herein or the continuous type.

The invention is particularly suited to inkjet printers that are used to print with different inks or printing liquids. The differences in the inks (or printing liquids) may be in color and/or other physical ink characteristics. The different inks may be used at different times to be ejected from the same printhead or used in printers with multiple printheads so that inks of different colors or inks with different other physical characteristics are printed substantially simultaneously, typically in register for printing the different inks on the same receiver sheet. The signal generator (or other controller) will store (such as in a memory or store in a memory signals to generate such waveforms) the different electrical drive waveforms signals 31 each suitably tuned for each respective printhead and/or ink to produce for each ink a discrete drop from a respective inkjet printer orifice which drop is free of satellites.

While different embodiments, applications and advantages of the invention have been shown and described with sufficient clarity to enable one skilled in the art to make and use the invention, it would be equally apparent to those skilled in the art that many more embodiments, applications and advantages are possible without deviating from the inventive concepts disclosed, described, and claimed herein. The invention, therefore, should only be restricted in accordance with the spirit of the claims appended hereto or their equivalents, and is not to be restricted by the specification, drawings or the description of the preferred embodiments.

The invention has been described in detail with particular reference to certain preferred embodiments thereof, but it will be understood that variations and modifications can be effected within the spirit and scope of the invention.

What is claimed is:

1. A method of operating an inkjet printhead comprising:

providing an inkjet orifice of the printhead located within a predetermined spacing of less than 500 micrometers from a receiver member that is moving relative to the orifice so as to present different portions of the receiver member to the orifice at the predetermined spacing for recording ink droplets on the receiver member;

providing electrical drive signals to the printhead, the electrical drive signals being adapted to enable the printhead to generate a droplet of a printing liquid; and forming a free droplet of the printing liquid substantially free of any satellites between the orifice and the receiver member and depositing the droplet upon the receiver member.

2. The method of claim 1 and wherein the shape, amplitude and/or frequency of the drive signals are adapted to generate the droplet.

3. The method of claim 2 wherein the droplet is formed of a printing liquid having a density of 1.0–1.1 grams/cc, a surface tension in the range of 32–36 dynes/cm and a viscosity in the range of 2–6 cp.

4. The method of claim 3 wherein the predetermined spacing is in the range of 50 to less than 500 micrometers.

5. The method of claim 1 wherein the droplet is formed of a printing liquid having a density of 1.0–1.1 grams/cc,a surface tension in the range of 32–36 dynes/cm, and a viscosity in the range of 2–6 cp.

6. The method of claim 5 wherein the printhead includes an ink delivery channel that is actuated with a piezoelectric transducer.

7. The method of claim 6 wherein the predetermined spacing is in the range of 50 to less than 500 micrometers.

8. The method of claim 1 wherein the predetermined spacing is in the range of 50 to less than 500 micrometers.

9. The method of claim 8 wherein the printhead includes an ink delivery channel that is actuated with a piezoelectric transducer.

10. The method of claim 8 wherein the droplet is formed of a printing liquid having a density of 1.0–1.1 grams/cc, a surface tension in the range of 32–36 dynes/cm, and a viscosity in the range of 2–6 cp.

11. The method of claim 1 and wherein the printhead is controlled by a controller which stores electrical drive signals for different printing liquids, the drive signals each being specially tuned with respect to a respective printing liquid to form, for each different printing liquid, a free droplet of printing liquid substantially free of any satellites between the orifice and the receiver member.

12. The method of claim 1 and wherein the printhead is part of a printer apparatus that has plural printheads, and the printheads are controlled by a controller which stores respective electrical drive signals for respective different printing liquids which are each printed respectively by a respective one of the plural printheads, and the controller enables the respective printheads with respective electrical drive signals that are each specially tuned to generate a droplet, from each of the plural printheads, of the respective printing liquid that is free of any satellites between the orifice and the receiver member.

13. The method of claim 1 wherein an ink delivery channel communicates with the orifice and wherein the ink delivery channel is formed of or includes a piezoelectric transducer which is responsive to the drive signals.

14. The method of claim 1 and wherein the droplets are deposited on the receiver member at a resolution of between 1200 and 2400 dpi.

15. The method of claim 14 and wherein droplet volume is in the range of 0.5–30 picoliters.

16. The method of claim 1 and wherein droplet volume is in the range of 0.5–30 picoliters.

17. The method of claim 1 and wherein the receiver member is a printing plate.

18. An inkjet printing apparatus comprising:

a printhead having an inkjet orifice within a predetermined spacing of less than 500 micrometers from a receiver member that is moving relative to the orifice so as to present different portions of the receiver member to the orifice at the predetermined spacing for recording ink droplets on the receiver member; and a source of electrical drive signals to the printhead, the electrical drive signals being adapted to enable the printhead to generate a free droplet substantially without presence of any satellites that would otherwise form a mark on the receiver member.

19. The apparatus of claim 18 wherein an ink delivery channel communicates with the orifice and the channel includes a printing liquid having a density of 1.0–1.1 grams/cc, a surface tension in the range of 32–36 dynes/cm, and a viscosity in the range of 2–6 cp.

20. The apparatus of claim 19 wherein the delivery channel is formed of or includes a piezoelectric transducer which is responsive to the drive signals.

21. The apparatus of claim 18 wherein the printhead is part of a printer apparatus that has plural printheads, and the printheads are controlled by a controller which stores respective electrical drive signals for respective different printing liquids which are each printed respectively by a respective one of the plural printheads, and the controller enables the respective printheads with respective electrical drive signals that are each specially tuned to generate a droplet, from each of the plural printheads, of the respective printing liquid that is free of any satellites between the orifice and the receiver member, an inkjet orifice of each of the respective printheads is within a predetermined spacing of between 50 micrometers and less than 500 micrometers, and wherein a respective ink delivery channel associated with each respective printhead communicates with the inkjet orifice of each of the respective printheads and each respective channel includes a printing liquid having a density of 1.0–1.1 g/cc, a surface tension of 32–36 dynes/cm, and a viscosity of 2–6 cp.

22. The apparatus of claim 21 wherein each respective delivery channel is formed of or includes a piezoelectric transducer which is responsive to the drive signals.

23. The apparatus of claim 18 wherein the predetermined spacing is in the range of 50 to less than 500 micrometers.

24. The apparatus of claim 23 and wherein an ink delivery channel communicates with the orifice and the channel includes a printing liquid having a density of 1.0–1.1 grams/cc, a surface tension in the range of 32–36 dynes/cm and a viscosity in the range of 2–6 cp.

25. The apparatus of claim 24 wherein the ink delivery channel is formed of or includes a piezoelectric transducer which is responsive to the drive signals.

26. The apparatus of claim 18 wherein an ink delivery channel communicates with the orifice and wherein the ink delivery channel is formed of or includes a piezoelectric transducer which is responsive to the drive signals.

* * * * *

UNITED STATES PATENT AND TRADEMARK OFFICE

CERTIFICATE OF CORRECTION

PATENT NO. : 6,428,135 B1
DATED : August 6, 2002
INVENTOR(S) : Anthony R. Lubinsky et al.

It is certified that error appears in the above-identified patent and that said Letters Patent is hereby corrected as shown below:

Title page,
The terminal disclaimer filed on February 6, 2002 and identifying the pending second application as application No. U.S. 08/679,931 incorrectly identified the pending second application. The correct identification of this pending second application is -- application No. U.S. 09/679,931 --.

The terminal disclaimer filed on February 6, 2002 and identifying the pending second application as application No. U.S. 08/680,378 incorrectly identified the pending second application. The correct identification of this pending second application is -- application No. U.S. 09/680,378 --.

Signed and Sealed this

Twenty-fifth Day of May, 2004

JON W. DUDAS
*Acting Director of the United States Patent and Trademark Office*